US009434571B2

(12) United States Patent
Yamazaki

(10) Patent No.: US 9,434,571 B2
(45) Date of Patent: Sep. 6, 2016

(54) BOOKLET PROCESSING UNIT

(71) Applicant: Kabushiki Kaisha Toshiba, Tokyo (JP)

(72) Inventor: Akihiro Yamazaki, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 14/211,369

(22) Filed: Mar. 14, 2014

(65) Prior Publication Data

US 2014/0284174 A1 Sep. 25, 2014

(30) Foreign Application Priority Data

Mar. 21, 2013 (JP) ..... 2013-059115

(51) Int. Cl.

| | |
|---|---|
| ***B65H 43/04*** | (2006.01) |
| ***B41F 17/02*** | (2006.01) |
| ***B41J 3/28*** | (2006.01) |
| ***B41J 3/50*** | (2006.01) |

(52) U.S. Cl.

CPC ..... *B65H 43/04* (2013.01); *B41F 17/02* (2013.01); *B41J 3/283* (2013.01); *B41J 3/50* (2013.01)

(58) Field of Classification Search

None

See application file for complete search history.

(56) References Cited

U.S. PATENT DOCUMENTS 6,144,033 A * 11/2000 Kokubu ..... B29D 30/0633 250/358.1

7,375,636 B1 * 5/2008 Martin ..... G01R 31/2822 340/10.1

FOREIGN PATENT DOCUMENTS

WO 2009037414 A2 3/2009

OTHER PUBLICATIONS

Official Action issued in related Korean Patent Appln. No. 10-2014-0019239 mailed Sep. 18, 2015 (5 pages).

* cited by examiner

*Primary Examiner* — Kavel Singh

(74) *Attorney, Agent, or Firm* — Baker Botts L.L.P.

(57) ABSTRACT

According to one embodiment, a booklet processing unit is disclosed. It includes a conveyance means for conveying a booklet containing an IC chip along a conveyance way; a printing means for printing a first particular information in the booklet; a recording means for recording a second particular information on the IC chip; a distinguishing means for distinguishing the quality of the printing state of the booklet and a recording state of the IC chip; and a marking means which moves a marking component and marks the booklet when the booklet is identified as being in a poor state by the distinguishing means such that the IC chip is avoided by the marking.

5 Claims, 5 Drawing Sheets

BOOKLET PROCESSING UNIT

FIELD

The embodiment form of the present invention is related to a booklet processing unit.

BACKGROUND

The booklet processing unit is equipped with IC-RW which inspects the record state of the inspection department for inspecting the printing quality printed to the booklet, and IC chip built into the booklet.

Moreover, the mechanism which separates into this booklet processing unit a booklet with good printing state and record state of IC chip, the booklet with a printing state is faulty, and a booklet with the record state of IC chip is faulty is established.

That is, when (1) printing state and the record state of IC chip are good, it discharges to a normal booklet accumulation warehouse.

(2) When a printing state or the record state of IC chip is poor, it is discharged to the poor booklet accumulation warehouse.

When the printing state of (2) and the record state of IC chip are poor, in order to distinguish from a normal booklet, a check mark is attached to a poor booklet.

As a mechanism which attaches this check mark, an edge type—shaped roller is formed near the conveyance way of a booklet, and what attaches a check mark is known by making a conveyance on the street project and pushing this edge type roller against a booklet.

Or a poor cause will not originate in printing of a booklet whether it is a thing resulting from IC chip, it becomes impossible however, to investigate the thing resulting from equipment, when attaching a check mark to a booklet and it damages [there was a possibility of damaging built—in IC chip and] by this method.

Then, after making it stagnate in a conveyance on the street (IC-RW part upper part), he is trying to remove from a conveyance on the street in the former, without conveying a booklet to an edge type roller, when the record state of IC chip is poor.

SUMMARY

However, while removing the booklet from the conveyance way when a booklet was made to stagnate in a conveyance on the street (IC-RW part upper part) as described above, processing of a following booklet could not be advanced, but even the printing job by the side of the upper stream stopped, and there was a problem causing processing efficiency to fall.

Then, it aims at offering the booklet processing unit which makes processing of the booklet which follows continueable by carrying out marking of the check mark, without damaging IC chip with the form of this embodiment, when the record state of IC chip is poor.

The Means for Solving a Subject

In order to solve the above-mentioned problem, the form of this embodiment, a conveyance means to convey the booklet which contains an IC chip along a conveyance way, and a printing means to print particular information in the above-mentioned booklet, have a record means to record peculiar information on the above-mentioned IC chip, a distinction means to distinguish the quality of the printing state of the above-mentioned booklet, and a record state of the above-mentioned IC chip, and a marking component, and by the above-mentioned distinction means, the marking means which moves the above-mentioned marking component and carries out marking of the check mark so that the IC chip may be avoided is provided to the booklet that is distinguished as poor.

BRIEF EXPLANATION OF THE DRAWINGS

Aspects of this disclosure will become apparent upon reading the following detailed description and upon reference to the accompanying drawings. The description and the associated drawings are provided to illustrate embodiments of the invention and not limited to the scope of the invention.

Figure.

Figure 6:
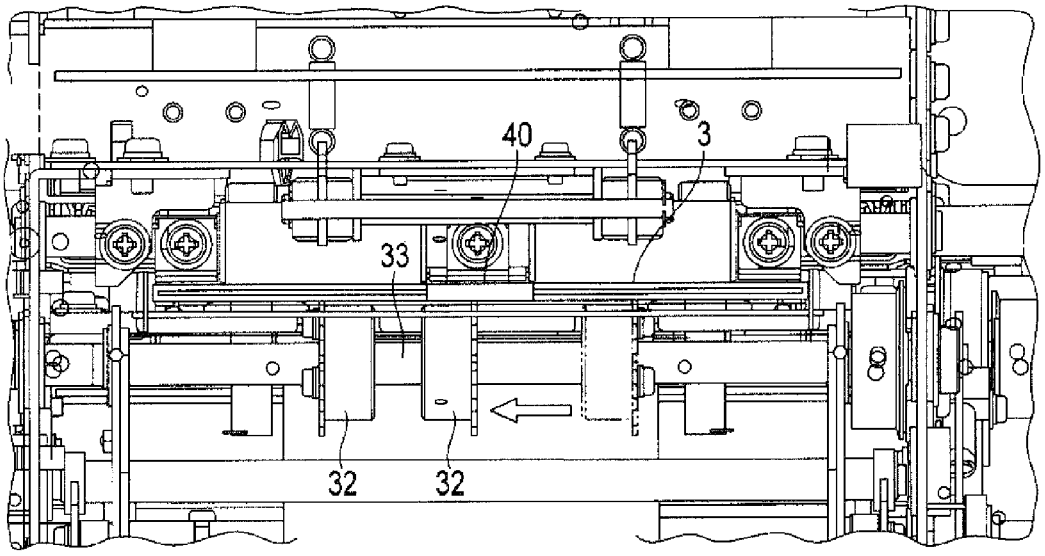
FIG. 6 The state where the edge type roller of FIG. 4 was moved to the position corresponding to IC chip of a booklet is shown.
Figure 7:
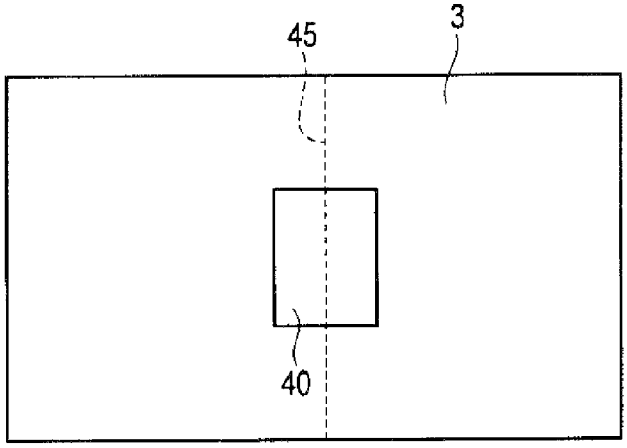

FIG. 7 The figure showing the state where IC chip was damaged by the marking mechanism of FIG. 6.

DETAILED DESCRIPTION

Hereafter, the form of embodiment is explained with reference to drawings.

Figure 1:
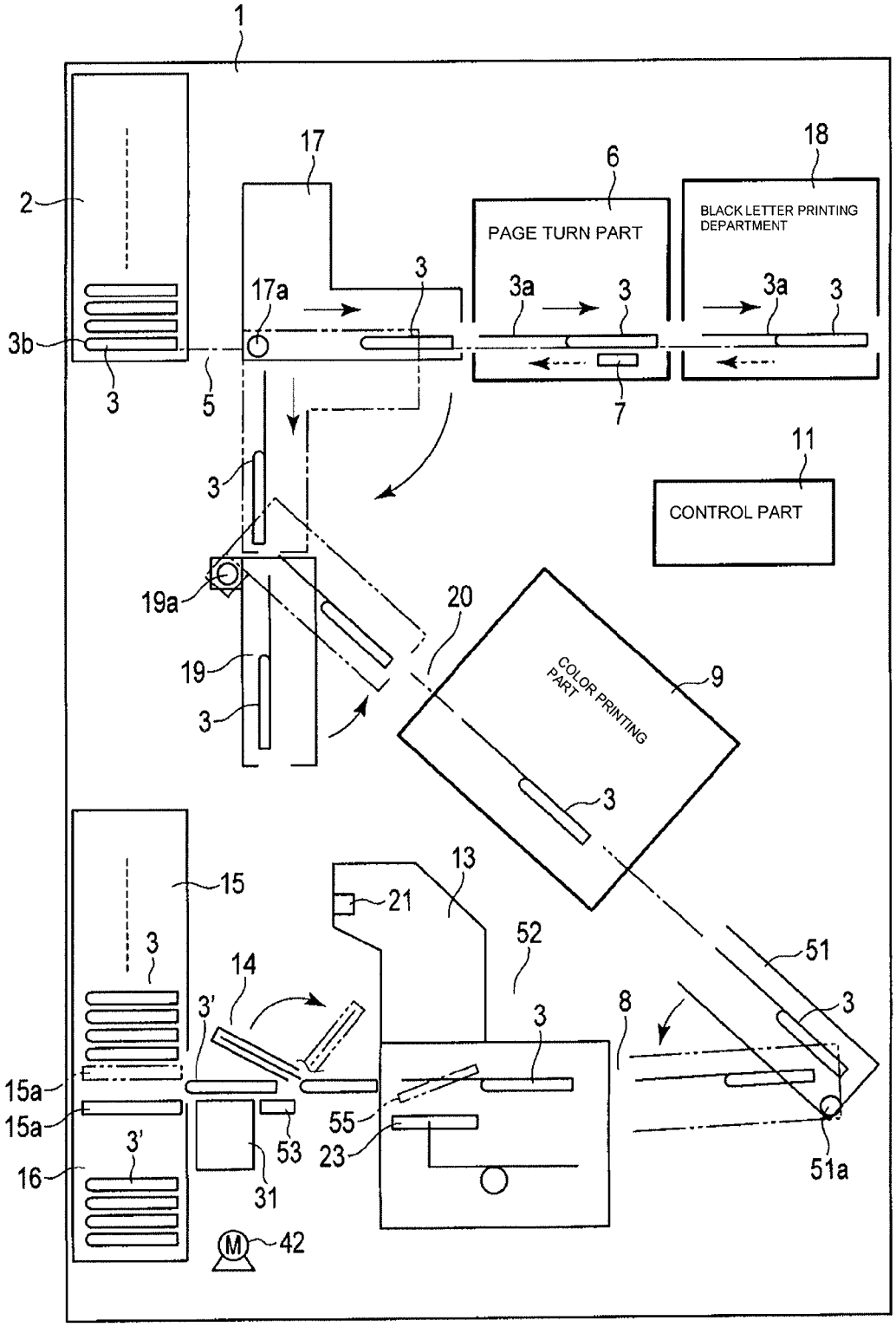
FIG. 1 The rough composition figure showing the booklet processing unit which is a form of 1 embodiment.

FIG. 1 is a rough composition figure showing the booklet processing unit which is a form of 1 embodiment.

FIG. 1 is a main part of equipment, and the booklet feed section 2 is formed in top 1 side part in this main part 1 of equipment. The booklet 3 contains an IC chip in the state where it was closed, in this booklet feed section 2 is stored in the state of two or more volume lamination. The one booklet 3 in the booklet feed section 2 is taken out at a time from the lower part side, and is conveyed along the upper part side conveyance way 5. All over the upper part side conveyance way 5, the 1st change part 17 that changes the conveyance direction of a booklet, the page turn part 6 which turns over the page of the booklet 3, and the black letter printing department 18 are configured one by one along the booklet conveyance direction. The IC-RW part 7 as a record means is configured at the lower part side of the page turn part 6.

The change part 17 of the above 1st is rotated in a lower part 90 degrees focusing on the pivot 17*a*, and the 2nd change part 19 that changes the conveyance direction of the booklet 3 is formed in the lower part of this 1st change part 17. This 2nd change part 19 is rotated upwards focusing on the pivot 19*a*, and sends out the booklet 3 to the inclination conveyance way 20. The color printing part 9 as a printing means and the 3rd change part 51 which changes the conveyance direction of the booklet 3 are formed in the inclination conveyance way 20 along the conveyance direction of the booklet 3.

The color printing part 9 operates based on the printing information inputted into the control part (distinction means) 11 from an external terminal (not shown). Moreover, the 3rd change part 51 is rotated below focusing on the pivot 51*a*, and sends out the booklet 3 to the lower part side conveyance way 8 as a conveyance means.

All over the lower part side conveyance way 8, the inspection department 52 which inspects the printing surface of the page 3*a* where the booklet 3 was opened, the folding part 14 which folds up the page 3*a* on which the booklet 3 was opened, and the IC-RW part 53 are configured one by one along the conveyance direction of the booklet 3. Moreover, the accumulation warehouse 15 which accumulates the booklet 3 is established in the discharge end side of the lower part side conveyance way 8.

This elevator 15*a* is situated so that the elevator 15*a* may be established in the accumulation warehouse 15 and it may mention later when the booklet 3 is normal. The booklet 3 is conveyed upwards and it is accumulated, and when the booklet 3 is unusual, move evacuation is carried out upwards and the downward exclusion part 16 is made to carry out fall accumulation rather than a booklet introduction way, as a fictitious outline shows. In addition, based on the drive of the drive motor 42, it goes up and down the elevator 15*a*.

Next, processing operation of the above-mentioned booklet processing unit is explained.

The booklet 3 stored by the booklet feed section 2 is conveyed along the upper part side conveyance way 5, as one volume is taken out at a time from the thing by the side of the lower part, it files, the eye part 3*b* side is made into the back end side and a solid line arrow shows, it passes the 1st change part 17, and is sent to the page turn part 6. While the page which should be turned over from the control part 11 is specified as the page turn part 6 and this specified page is turned over by the page turn part 6, booklet particular information is written in that IC chip by the IC-RW part 7.

After this writing, the booklet 3 is conveyed by the black letter printing department 18 as a printing means, and black letter printing is carried out at that opened page 3*a*. After this printing, the booklet 3 is sent back as a dashed line arrow shows, it passes the page turn part 6, and is returned to the 1st change part 17. this—it returns and, in the back, the 1st change part 17 which shows by an arrow focusing on the pivot 17*a* is rotated at 190 degree lower and the booklet 3 is sent out to the 2nd change part 19.

After this sending out, as the 2nd change part 19 shows by an arrow focusing on the pivot 19*a*, it rotates upwards, and the booklet 3 is sent out on the inclination conveyance way 20. This booklet 3 is conveyed to the color printing part 9, and is color-printed by that opened page 3*a*. The booklet 3 is sent out to the 3rd change part 51 after this printing.

After this sending out, as the 3rd change part 51 shows by an arrow focusing on the pivot 51*a*, it rotate below, and the booklet 3 is sent out on the lower part side conveyance way 8. This booklet 3 is conveyed to the inspection department 52, that open printing surface of the page 3*a* is photo, and an inspection screen is acquired.

After this inspection, it is sent out, that opened page 3*a* is inserted into the page folding part 14, and the booklet 3 is folded up by being rotated, as the page folding part 14 shows by an arrow. The folded-up booklet 3 is conveyed along the lower part side conveyance way 8, and the booklet peculiar information currently recorded on the IC chip is read by the IC-RW part 53.

The control part 11 distinguishes whether the printing information inputted by the inspection screen acquired in the inspection department 52 and the external terminal (not shown) was compared, and it was printed and also recorded correctly while comparing the write-in information and reading information on the booklet with particular information over IC chip.

After this distinction, the booklet 3 is conveyed to the accumulation part 15, and is accumulated. Then the booklet 3 was printed and recorded correctly and it is distinguished at this time. When it was discharged on the elevator 15*a* in the booklet receipt position of the accumulation part 15, it was not printed and recorded correctly and it is distinguished, it is moved to the upper part from a booklet receipt position, and fallen accumulation of the elevator 15*a* is carried out into the exclusion part 16 of the lower part of the elevator 15*a*.

Figure 2:
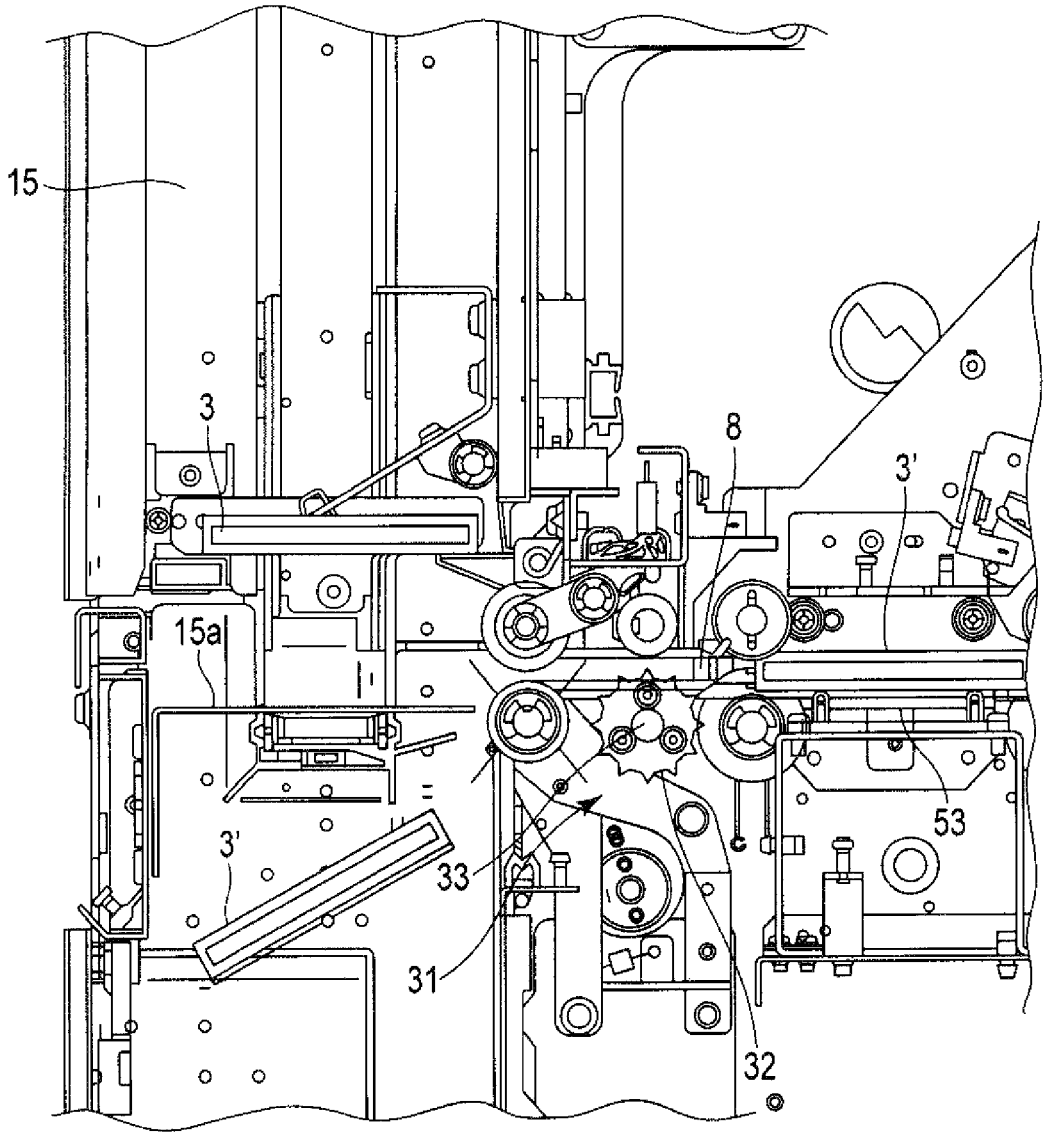
FIG. 2 The figure showing the booklet accumulation part and marking mechanism of FIG. 1 in detail.
Figure 3:
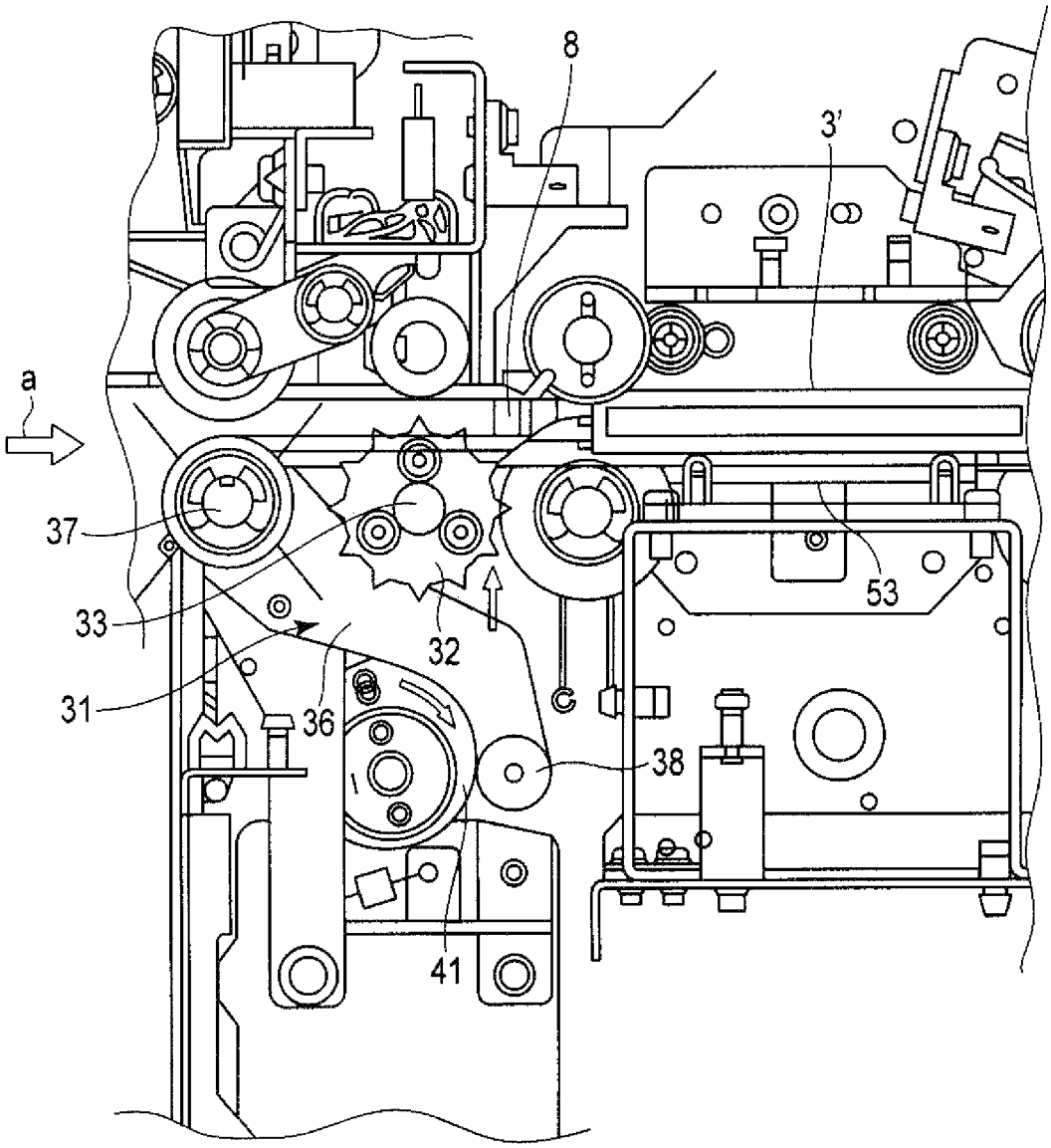
FIG. 3 The figure expanding and showing the marking mechanism of FIG. 2.

FIG. 2 is the above-mentioned accumulation warehouse 15 and a figure showing the marking mechanism 31 as a marking means in detail. FIG. 3 is a figure expanding and showing the marking mechanism 31 of FIG. 2, and FIG. 4 is an elevational view seen from FIG. 3 Nakaya mark a.

The marking mechanism 31 was formed in the lower part of the lower part side conveyance way 8, and is equipped with the edge type roller 32 as a pair of marking components. In a predetermined interval, a pair of edge type rollers 32 consist in the shaft 33, and are configured, and the shaft 33 is supported by the used machine style which is not illustrated, enabling free rise and fall.

Figure 4:
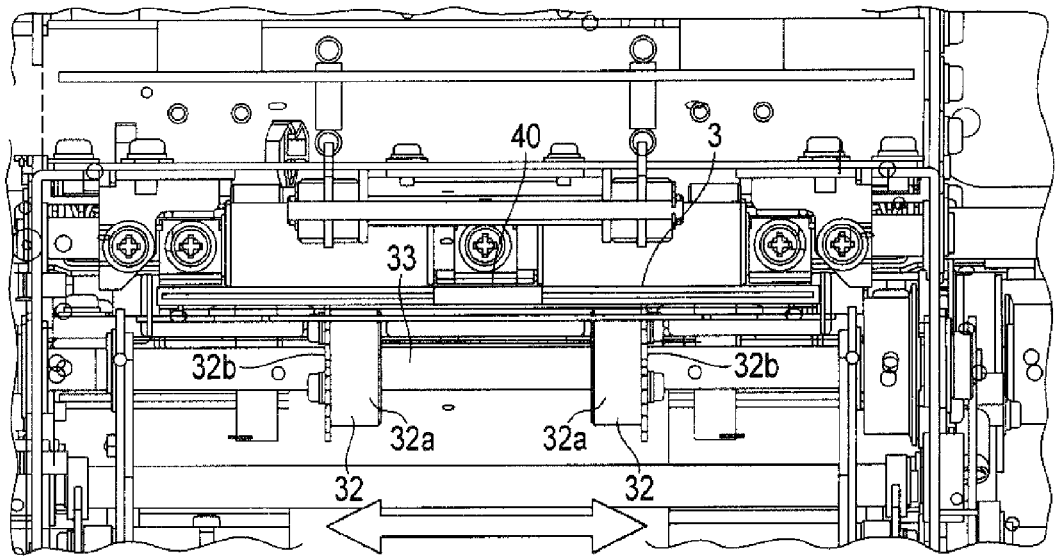
FIG. 4 The elevation view showing the marking mechanism of FIG. 3.

The edge type roller 32 consists of the roller part 32*a* and the cutting part 32*b* attached to this roller part 32*a*, as shown in FIG. 4. It is configured along the direction of an axis of the shaft 33, enabling movement and free rotation, it is moved to arbitrary positions, and rotation of the roller part 32*a* of the edge type roller 32 is attained in the position.

On the other hand, the drive arm 36 for making it go up and down the shaft 33, as shown in FIG. 3, is formed in the lower part of the shaft 33 of the edge type roller 32. The one end part side is supported by the pivot 37 free [rotate], this drive arm 36 is received in the other end part side, and the roller 38 is attached. And the cam roller 41 is supported by the receptacle roller 38.

It is connected through the power transfer mechanism which is not illustrated to the drive motor (shown in FIG. 1) 42 of the elevator 15*a* of the above-mentioned accumulation warehouse 15, and the cam roller 41 is rotated based on carrying out move shunting of the elevator 15*a* upwards by the drive of the drive motor 42.

The drive arm 36 is rotated upwards focusing on the pivot 37, moves the shaft 33 of the edge type roller 32 upwards, and makes the edge type roller 32 project in the marking position on the lower part side conveyance way 8 by rotation of the cam roller 41.

Next, the marking operation of the marking mechanism 31 to a poor booklet is explained.

First, slide movement of the edge type roller 32 of the marking mechanism 31 is carried out to the position which avoids the IC chip 40 of the booklet 3 along with the shaft 33.

And while the write-in information over the IC chip 40 of the booklet 3 and reading information on peculiar information are compared by the control part 11, the printing information inputted by the inspection screen acquired in the inspection department 52 and the external terminal (not shown) is compared. And when the printing state of the booklet 3 or the record state of the IC chip 40 was not right and it is distinguished by this collation, the drive motor 42 of the elevator 15*a* drives.

While move evacuation of the elevator 15*a* is carried out upwards by this drive, the cam roller 41 of the marking mechanism 31 is rotated through a power transfer mechanism by it, and the receptacle roller 38 of the drive arm 36 is pushed up by it. Thereby, the drive arm 36 is rotated upwards focusing on the pivot 37, and the receptacle roller 38 is pushed up. Thereby, the shaft 33 of the edge type roller 32 is pushed upwards, and the edge type roller 32 is made to project to the marking position of the lower part side conveyance way 8.

Figure 5:
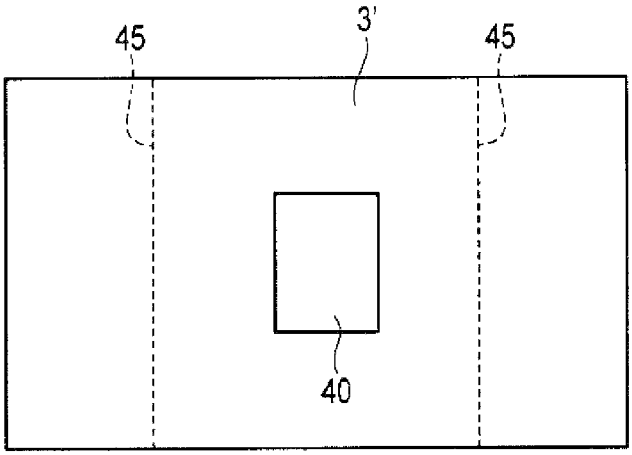
FIG. 5 The figure showing the booklet in which marking of the check mark was carried out by the marking mechanism of FIG. 4.

Thus, after the edge type roller 32 is projected on the lower part side conveyance way 8, poor booklet 3' is conveyed in a marking position, and as the cutting part 32*b* of the edge type roller 32 shows in FIG. 4, it is dashed, and the edge type roller 32 rotates. Thereby, as shown in FIG. 5, marking of the check mark 45 shown with a dashed line is carried out to poor booklet 3'. Thus, fall accumulation of poor booklet 3' to which marking of the check mark 45 was carried out is carried out at the exclusion part 16.

As described above, in order to attach the edge type roller 32 in that direction of an axis to the shaft 33 according to the form of this embodiment, enabling free movement, when the edge type roller 32 can be arranged in the position which avoids the IC chip 40 and marking of the check mark 45 is carried out to poor booklet 3', the IC chip 40 is not damaged.

Therefore, it is not necessary to make poor booklet 3' stagnate on the lower part side conveyance way 8 like before, and to remove, the continuous processing of the processing of the booklet 3 which follows can be carried out without stagnation, and processing efficiency can be improved.

In addition, it may change into the state where can destroy the IC chip 40 and it cannot be used, on security. In such a case, as shown in FIG. 6, move arrangement of the edge type roller 32 is carried out intentionally in the position corresponding to the IC chip 40.

It becomes possible to damage the IC chip 40 of the booklet 3 with the edge type roller 32, and to destroy by this, in a marking position.

In addition, the above-mentioned form of embodiment is shown as an example, and limiting the range of invention does not have intention of it. This new embodiment form can be carried out with other various forms, is a range which does not deviate from the summary of invention, and various abbreviations and replacement are performed and it can make a change. The embodiment form and its modification are included in invention indicated to the claim, and its equal range while they are included in the range and summary of invention.

What is claimed is:

1. A booklet processing unit comprising:

a conveyor for conveying a booklet containing an IC chip along a conveyance way;

a printer for printing a first particular information in the booklet;

a recorder for recording a second particular information on the IC chip;

a distinguisher for distinguishing the quality of the printing state of the booklet and a recording state of the IC chip; and a marker which moves marking component and marks the booklet when the booklet is identified as being in a poor state by the distinguisher such that the IC chip is avoided by the marking by arranging the marker along a shaft in a position where the marking component avoids the IC chip when marking the booklet.

2. The booklet processing unit according to claim 1 wherein the marking component is set to move in the cross direction to the conveyance direction of the booklet.

3. The booklet processing unit according to claim 1 or 2 wherein the marking components are edge type rollers.

4. The booklet processing unit according to claim 3 wherein the edge type rollers rotate on a shaft and move along the direction of the shaft.

5. The booklet processing unit according to claim 3 or 4 wherein the edge type rollers are set on the conveyance way.

* * * * *